US009419376B1

(12) United States Patent
Blum et al.

(10) Patent No.: US 9,419,376 B1
(45) Date of Patent: Aug. 16, 2016

(54) MULTIPURPOSE, ELECTRONICALLY VERSATILE CONNECTOR FOR WEARABLE ELECTRONICS

(71) Applicant: Google Inc., Mountain View, CA (US)

(72) Inventors: Jeremy Evan Blum, San Francisco, CA (US); Mike Jastrzebski, San Francisco, CA (US); Haley Toelle, San Francisco, CA (US)

(73) Assignee: Google Inc., Mountain View, CA (US)

( * ) Notice: Subject to any disclaimer, the term of this patent is extended or adjusted under 35 U.S.C. 154(b) by 0 days.

(21) Appl. No.: 14/255,454

(22) Filed: Apr. 17, 2014

(51) Int. Cl.
*H01R 11/30* (2006.01)
*H01R 13/62* (2006.01)

(52) U.S. Cl.
CPC ..... *H01R 13/6205* (2013.01)

(58) Field of Classification Search
CPC ..... H01R 13/6205
USPC ..... 439/39
See application file for complete search history.

(56) References Cited

U.S. PATENT DOCUMENTS

| | | | | |
|---|---|---|---|---|
| 6,797,891 | B1 | 9/2004 | Blair et al. | |
| 7,351,066 | B2 | 4/2008 | DiFonzo et al. | |
| 7,845,967 | B1 | 12/2010 | Shu et al. | |
| 7,866,996 | B2 | 1/2011 | Achsaf et al. | |
| 8,535,088 | B2 * | 9/2013 | Gao et al. | 439/490 |
| 8,894,419 | B1 * | 11/2014 | Buelow | 439/39 |
| 2004/0018774 | A1 * | 1/2004 | Long et al. | 439/620 |
| 2007/0072442 | A1 * | 3/2007 | DiFonzo et al. | 439/39 |
| 2012/0021619 | A1 * | 1/2012 | Bilbrey et al. | 439/39 |
| 2012/0265911 | A1 | 10/2012 | Connolly | |
| 2012/0282786 | A1 * | 11/2012 | Neel | 439/39 |
| 2012/0326736 | A1 | 12/2012 | Chadbourne et al. | |
| 2013/0040470 | A1 * | 2/2013 | Gao et al. | 439/39 |
| 2013/0157477 | A1 * | 6/2013 | McCormack | 439/39 |
| 2013/0164949 | A1 * | 6/2013 | Riering-Czekalla et al. | 439/39 |
| 2013/0267101 | A1 * | 10/2013 | Furness et al. | 439/39 |
| 2013/0295781 | A1 * | 11/2013 | Gualino et al. | 439/39 |
| 2013/0303000 | A1 * | 11/2013 | Witter et al. | 439/39 |
| 2014/0099801 | A1 * | 4/2014 | Liao | 439/39 |

* cited by examiner

*Primary Examiner* — Abdullah Riyami
*Assistant Examiner* — Nelson R Burgos-Guntin
(74) *Attorney, Agent, or Firm* — Lerner, David, Littenberg, Krumholz & Mentlik, LLP

(57) ABSTRACT

An example of a connector for host devices is provided. Aspects of the disclosure relate generally to a connector that allows a user to blindly connect the connector to a host device. For example, a magnetic system between the connector and host device may attract when the connector is oriented correctly with the host device's socket, and repel when the connector is incorrectly oriented. The connector may have a cord that is positioned such that, when the user incorrectly orients the connector over the host device's socket, the cord may interfere with the host device's housing, thereby indicating to the user to re-orient the connector. The connector may also employ multiplexed pins so the pins can perform more than a single function. For example, the data (D+/D−) pins may transmit music in the form of audio signals, and information content in the form of electrical signals.

19 Claims, 25 Drawing Sheets

1000

400

| Resistor Value | 1 | 2 | 3 | 4 |
|---|---|---|---|---|
| **Action** | Headphones/ speakers are connected. Disable host device's speakers and send sound signals to connected device | Attached is "USB OTG" device compatible. Perform OTG handshake, deliver power from host, and communicate over USB | Microphone is connected. Disable microphone on host device and allow signals to be sent from microphone to host device | Debug mode. Enable debugging data to be sent from host device to debugging device |

500
FIGURE 5

| Contact/Pin | Power | D- | D+ | ID | Ground |
| --- | --- | --- | --- | --- | --- |
| **Capabilities** | Transmit power or microphone signals | Transmit data, audio, etc. | Transmit data, audio, etc. | Transmit identification (resistor) value of transmitting device | Maintain conducting path |

800
FIGURE 8

MULTIPURPOSE, ELECTRONICALLY VERSATILE CONNECTOR FOR WEARABLE ELECTRONICS

BACKGROUND

Connectors serve various functions when used with an electronic device. Connectors may be used to charge an electronic device, transmit data, transmit audio signals including music through headphones or through a microphone, and provide debugging functions for developers. Micro B USB is one example of a connector for electronic devices. As society continues to develop different types of technology, such as wearable electronic devices, the design of standard connectors may be inadequate to complement the needs of this new technology.

BRIEF SUMMARY

An apparatus provides for a connector that a user can blindly connect into a socket with little to no effort. In accordance with one embodiment, a connector adapted to mate with a socket in a host device is provided. The connector comprises a connector housing, the connector housing having a connector surface and a bottom surface, a first side and second side extending in between the connector and bottom surfaces, and a first end between the connector and bottom surfaces and also between the first and second sides; a plurality of connector pins extending from the connector surface of the connector housing; at least one connector magnet coupled to the connector surface of the connector housing, the at least one connector magnet attracts a corresponding first host magnet in the socket of the host device when the connector is positioned in a given orientation, and the at least one connector magnet repels a second host magnet when the connector is positioned in a different orientation; and a cord attached to the first end of the connector housing.

In one example when the connector mates with the socket, at least part of the cord is configured to be flush with the housing of the host device. In another example, the connector includes a transceiving device coupled to an end of the cord opposing the connector; and wherein a functionality provided by at least one of the connector pins is based on a type of the transceiving device. In this example, the connector is configured to store an ID resistor value, the ID resistor value being identified by the host device through a first connector pin of the plurality of connector pins; and the host device is configured to determine a type of transceiving device connected to the second connector based on the received ID resistor value.

As one example, the connector surface comprises a plurality of mating cups, each mating cup surrounding at least a portion of one of the plurality of pins. In this example, each connector pin may have a first portion and a second portion, the first portion being enclosed within the connector housing and the second portion being outside the connector housing and surrounded by the mating cup. In a further example, the connector may have a spring coiled around the first portion of each connector pin; a ledge component contained inside the connector housing, the ledge component having a first side facing an inside portion of the connector housing, and a second side facing the spring; wherein the spring is adapted to exert pressure against the second side of the ledge component, causing the first side of the ledge component to create a seal against the inside portion of the connector housing. As another example, the connector includes a first connector magnet and a second connector magnet; the first connector magnet is positioned on a first portion of the connection surface; the second connector magnet is positioned on a second portion of the connector surface; and at least one of the plurality of pins is positioned between the first portion and the second portion. In another example, a plurality of magnets are arranged in an alternating pattern with the connector pins. As another example, the cord is attached to the first end of the connector housing such that the cord is obstructed by the host housing when the connector is incorrectly oriented with the socket.

In accordance with another embodiment, a host device including a host housing and a socket adapted to mate with a connector is provided. The socket comprises a recess in a recess in the host housing, the recess including a base surface and a wall defining an outside perimeter of the recess in the host housing; a plurality of host pins positioned in the recess, the host pins shaped to fit within a corresponding portion of the connector; and at least one host magnet positioned in the recess, wherein the at least one host magnet attracts a corresponding first connector magnet when the connector is positioned in a given orientation, and the at least one host magnet repels a second connector magnet when the connector is positioned in a different orientation. In a further example, the host device is configured to identify an ID resistor value from a first host pin of the plurality of host pins, the first host pin is configured to receive an ID resistor value from the connector through the connector, and wherein the host device is adapted to configure the functions of at least one of the host device and the host pins based on the identified ID resistor value. In yet a further example, the at least one host magnet includes a first host magnet and a second host magnet; the first host magnet is positioned on a first portion of the socket; the second host magnet is positioned on a second portion of the socket; and at least one of the plurality of host pins is positioned between the first portion and the second portion.

In another example, the host device has a plurality of magnets, the plurality of magnets are arranged in an alternating pattern with the host pins.

In another embodiment, a connector system is provided. The connector system comprises a connector, which comprises a connector housing, the connector housing having a connector surface and a bottom surface, at least a first side and second side extending in between the connector and bottom surfaces, and a first end between the connector and bottom surface; at least one connector pin extending from the connector surface of the connector housing; a first connector magnet coupled to a first portion of the connector surface; and a second connector magnet coupled to a second portion of the connector surface; a socket adapted to mate with the connector, the socket comprising: a recess, the recess including a base surface and a wall defining an outside perimeter of the recess; at least one host pin positioned in the recess, the at least one host pin positioned and shaped to contact the at least one connector pin; a first socket magnet adapted to attract the first connector magnet when the connector is positioned correctly within the socket; and a second socket magnet repelling the first connector magnet when the connector is positioned incorrectly with respect to the socket.

In a further example, the connector includes at least one mating cup formed on the connector surface and surrounding at least a portion of the at least one connector pin. As another example, the recess is formed in a host device, the host device comprising one or more processors; and memory coupled to the one or more processors; wherein the one or more processors are configured to: identify an ID resistor value from the connector on an opposite end of the cord from the connector; determine a type of transceiving device based on the ID resistor value; and perform a function based on the determined ID resistor value. In a further example, the ID resistor value is transmitted through an ID pin on the connector and the host device.

BRIEF DESCRIPTION OF THE DRAWINGS

FIG. 5 is an example of resistor values in accordance with aspects of the disclosure.

FIG. 8 illustrates an example of pin functionality in accordance with aspects of the disclosure.

DETAILED DESCRIPTION

Figure 1:
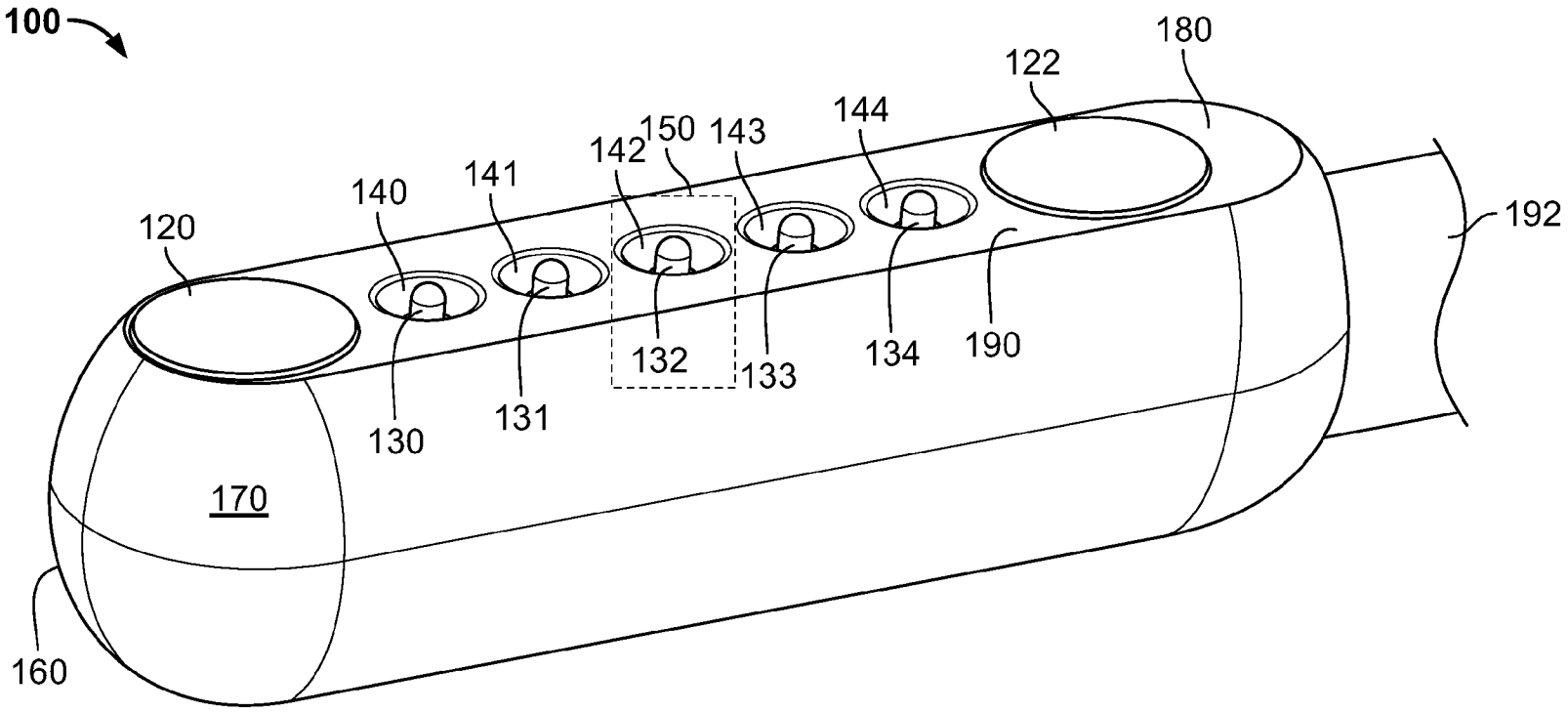
FIG. 1 is an example detailed view of a connector in accordance with aspects of the disclosure.

Aspects of the technology generally pertain to a connector system that is comprised of a connector and a socket. The connector system may be used for any of a variety of host devices, such as, for example, a head mountable display or other portable electronic devices. The connector system may be used to facilitate a connection between the host device and, a secondary device, such as a charger, a computer, an audio source, a microphone, or any other transceiving device. For instance, a cord may extend below the connector and the secondary device, and signals may be exchanged between the devices through the cord. In another example, the connector may facilitate charging of the host device by transmitting current from a power source/outlet to the host device. In this scenario, the transceiving device would be a power plug that plugs into the power source. In another example, the connector may send audio signals to the transceiving device to relay sound. In this scenario, the transceiving device may be a pair of headphones or other device that can play music. As another example, the transceiving device may be a microphone that sends audio signals. In this regard, the audio signals may include music and/or a person's voice. In the latter case, the person may be communicating with another person or recording his or her voice.

The connector may have a plurality of pins that are capable of performing particular functions. The pins may also be multiplexed so as to perform more than a single function. The host device may have a socket that also has a plurality of pins, the socket pins of which correspond to the connector pins. Thus, when the connector is coupled to the socket of the host device, the transmittal of data, current, etc., may be accomplished through the respective pins. In addition, the socket may be positioned in a recess on the host device in a location where a user can easily access it. The recess of the socket may also generally match a shape of the connector. In one example, the socket of a head-mountable display may be positioned on an outside portion of the apparatus, such that the user can plug in the connector while wearing the head-mountable display. A top surface of the connector may be flush to the host device when connected. For example, this may be facilitated by the recess on the host device socket, the shape of the connector, the placement of the pins, and the placement of the cord.

In one example, each pin may be surrounded by a mating cup to protect it from outside interferences that could cause damage when the connector is not in use. The socket pins, on the other hand, are raised so as to establish a connection between the socket pins and connector pins.

One of the plurality of pins on the connector may be an ID pin which transmits a resistor value from the transceiving device to the host device. The host device may then use the resistor value to determine the type of transceiving device that is connected. For example, if the resistor value is set to a particular value when the connector and socket are connected, then the host device may determine that stereo ear buds are connected. In this scenario, the host device may reconfigure the pins so that audio signals (or sounds) should be delivered through the appropriate pins, and a speaker associated with the host device is disabled. Other modes in which the host device can reconfigure the functionality of the pins include factory programming mode, USB mode, charging mode, microphone mode, etc.

The connector and socket can blindly mate with each other with little or no effort. This may be particularly advantageous for wearable technology where the user is unable to easily see the socket. The present technology employs a magnetic connection system, created so that the connector is plugged into the socket in a particular direction. For instance, the socket of the host device may place magnets adjacent to the socket pins. The connector may also position magnets adjacent to the connector pins. When attempting to connect the connector with the socket, the polarity of the magnets may attract and cause a connection as long as the connector is oriented correctly with the socket. However, if the connector is incorrectly oriented then the polarity of the magnets may repel, thus preventing the socket and connector from mating. A magnetic connection system may also allow for an easier connection by requiring less force to be exerted by the user, for example, as compared to the force required to couple typical micro USB connectors. This is potentially advantageous when the user cannot see the socket as well.

The cord may be strategically attached on an end of the connector to make it difficult for a user to couple the connector with the host device socket if the connector is incorrectly oriented. For instance, as discussed above the host device includes a recess where the socket is located, the socket generally matching the shape of the connector. Because the cable is attached to the side of the connector, the connector cannot enter the recess where the pins are located because the cable may interfere. Accordingly, if a user attempts to force a connection when the connector is facing the wrong direction, then the placement of the cord will make it mechanically difficult for the user to connect the connector.

The thickness of the cord can also be varied based on the transceiving device that is connected. For charging a device, a more intense current may be necessary, thereby requiring a larger cord. For headphones, however, the amount of current is less so the cord may be thinner.

FIG. 1 illustrates one example of the connector described above. As shown in example 100 of FIG. 1, connector 160 includes a housing 170 that protects the internal components of the connector. The connector housing 170 may be comprised of a plastic, metallic, or other type of material that is capable of providing some form of protection to the internal components of the connector. The connector housing 170 forms an elongated shape, with a connector surface 180 and a bottom surface on an opposing side. Two sides extend between the top and bottom surfaces, and a first end and second end also extend between the top and bottom surfaces. According to one example, the sides and ends may all be formed of one continuous piece of material. For example, as shown in FIG. 1, the first and second ends may be rounded off and merge into the first and second sides. Similarly the top and bottom surfaces may also merge into the sides and ends.

The connector 160 includes a plurality of pins 130-134 located on the connector surface 180 of the connector housing 170. The connector pins may be used to transmit data, signals, current, etc. between the host device (not shown) and transceiving device (not shown). As shown in FIG. 1, the pins may be positioned in a straight line formation so that the row of pins is parallel to connector surface edge 190. While 5 pins are shown, any number of pins may be used. Moreover an arrangement of pins may be varied. For example, the pins can be spaced or aligned differently.

The pins 130-134 may be protrusions that extend outwardly from the connector surface 180 of the housing 170. As shown in FIG. 1, the pins may form a three-dimensional ovular shape, but other shapes and forms are also possible. The pins may be comprised of a metallic material or any other type of material that is capable of transmitting electrical signals, current, etc.

Each pin on the connector may be protected by mating cups. For example, FIG. 1 illustrates mating cups 140-144 which protect pins 130-134, respectively. The mating cups 140-144 protect the pins 130-134 by surrounding the pins with the housing 170 of the connector, thereby preventing the pins from being unnecessarily exposed. The mating cups may be particularly useful for situations when the connector is not mated with a host device. For example, if the connector scrapes against a foreign object then the pins may be protected by the mating cups that housing 170 forms around it. Without the mating cups, the pins may be damaged whenever the connector touches a relatively hard surface.

Figure 2:
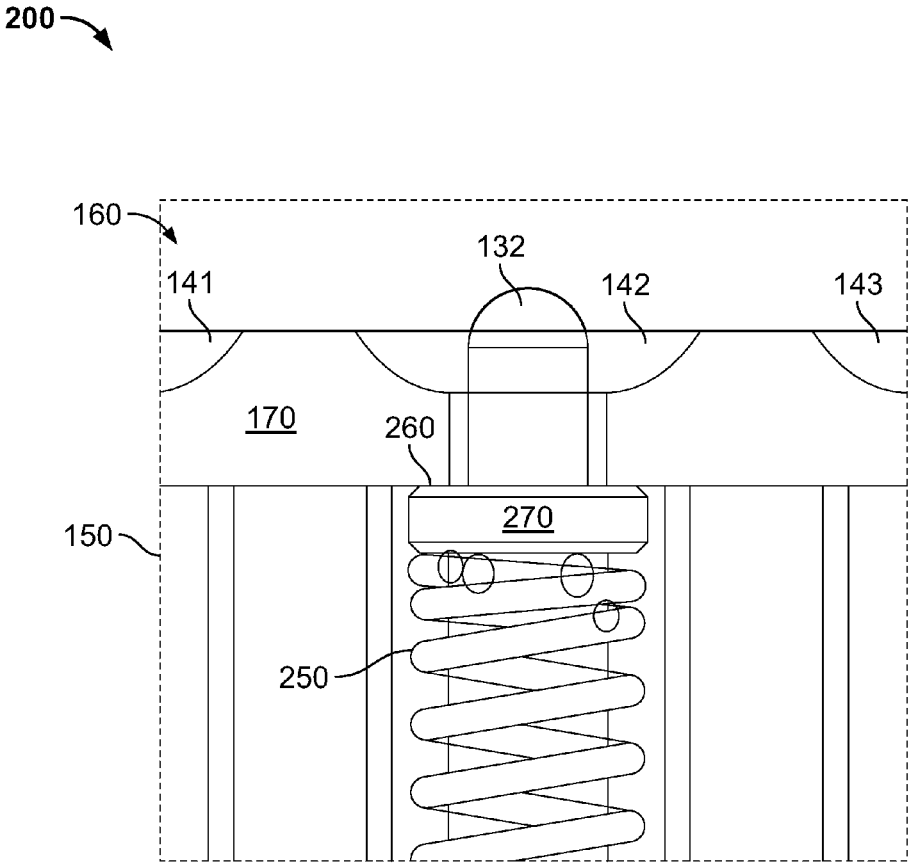
FIG. 2 is an exploded cutaway view of FIG. 1 illustrating an example of a spring loaded pin in accordance with aspects of the disclosure.

Example 200 of FIG. 2 is an enlarged view of portion 150 in FIG. 1, which captures connector pin 132. In this enlarged view, a "non-standard pogo" 250 design is implemented which uses an external coil spring. The external coil spring enables current to flow through different paths along the pogo's body, and thus allows more current to pass therethrough. In addition, the non-standard pogo 250 implements a small pitch between the pins that facilitates a higher current flow as well. The non-standard pogo 250 design may be compared to a conventional pogo design, which implements an internal coil spring. Such an arrangement may not allow for as much current to pass through as the pogo 250.

As shown in example 200 of FIG. 2, pre-loaded spring 250 exerts pressure on ledge 270, which in turn presses firmly against the connector housing 170. A seal 260 is then created which prohibits particles, water, etc. to get through. In addition, the circuitry and other components of the connector (with the exception of the pins) have been encapsulated by the seal 260 underneath the housing 370 of the connector 260. The seal is positioned directly underneath the housing 370, and as a result, outside particles are unable to damage the internal components of the connector.

The connector is also configured to withstand other types of damaging events. For example, the connector may prevent against electrical over/under-current conditions, short circuits, polarity reversals, and other dangerous electrical events. Mitigation is achieved through a combination of mechanical design, and electrical protection circuitry. For example, electrical protection circuitry may be achieved by using circuitry within the host device, such as overcurrent protection diodes, electrostatic discharge ("ESD") suppression for integrated circuits, chokes to block higher frequency alternating currents, fuses, etc.

Figure 3:
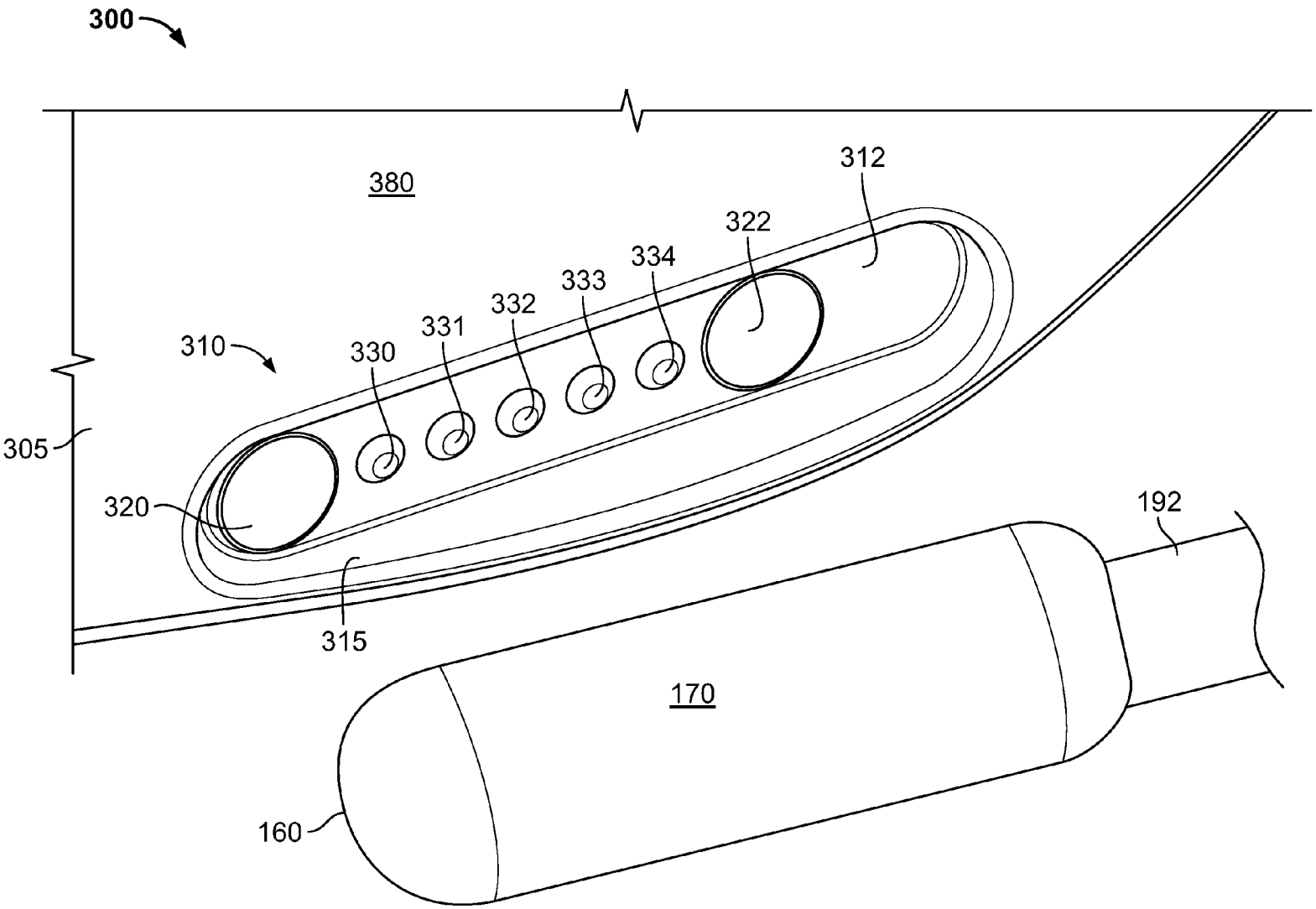
FIG. 3 is an example detailed view of a socket of a host device in accordance with aspects of the disclosure.

Referring back to FIG. 1, the connector surface 180 of connector 170 may have at least one magnet to facilitate a secure connection with the host device. Magnets 120 and 122 are positioned on the outside periphery of pins 130-134. The polarity of magnets 120 and 122 may attract with magnets that are present on the socket of the host device. For instance, host device 305 of example 300 of FIG. 3 shows magnets 320 and 322. The magnets of the host device and connector are arranged so that the connector can only mate with the host device in a single orientation. For example, magnets 120 and 320 may attract, but magnets 120 with 322 may repel. Similarly, magnets 122 and 322 may attract, but magnets 122 and 320 may repel. In this regard, if the connector is correctly oriented, then the magnets will facilitate coupling of the connector to the host device. However, if the connector is incorrectly oriented, then the magnets may repel, thereby guiding the user to reorient the connector.

The benefits of the magnets being strategically arranged in this way are particularly noticeable with wearable devices, such as a head-mounted display, because the user is unable to see the location of the socket. In this scenario, the benefit of the arrangement of the magnets is two-fold: 1) when the user correctly orients the connector, the magnets of the connector and host device will attract, thereby forming a connection; and 2) when the connector is incorrectly oriented, the polarization of the magnets may alert the user to re-orient the connector. The use of magnets in this manner also requires less force by the user so that the user can easily attach the connector to the host device. This also becomes particularly useful for wearable devices, where the user may want to blindly connect the connector without having to remove the host device, such as a head-mounted display. Thus, the magnetic connection system may help the user to blindly connect the connector with the host device.

As shown in FIGS. 1 and 3, cord 192 is attached to the first end of the housing 170 and extends outward therefrom. The cord may be comprised of an outer housing that surrounds wiring (e.g., copper) that is capable of transmitting electrical signals, including data power, current, etc. In one example, if the user should incorrectly orient the connector 160 when attempting to plug it into socket 310 of host device 305, the orientation of the cord 192 may make it physically difficult for the user to be able to mate the two devices. For instance, the physical difficulty may be that the cord 192 interferes with a part of the housing 380 of host device 305. As a result of the interference, the connector cannot physically establish a connection with the host device. On the other hand, when the connector is oriented (and ultimately plugged in) correctly, the cord 192 may be configured to be flush against and parallel to the housing of the host device. In this regard, the placement of the cord on the connector easily alerts the user that the connector is incorrectly oriented; and therefore, to re-orient the connector. The location of the cord on the connector may also indicate to the user from the outset which direction the connector should be facing. The strategic placement of the cord on connector 160 may also aid in the blind and effortless attachment of the connector to the host device.

Referring to FIG. 3, host device 305 may contain a socket 310 that generally matches the shape of connector 160. For example, as shown in example 300 of FIG. 3, socket 310 may be formed by a recess in outer housing 380. The socket 310 may have a base surface 312 and a wall 315 that defines a perimeter of the socket. The wall 315 may generally fit the shape of the connector surface of the connector 160, as shown by the alignment of connector 160 with socket 310 in FIG. 2.

The socket 310 of the host device may have a plurality of pins 330-334 that protrude outwardly from base surface 312. For example, the pins 330-334 may be shaped as raised dots, frustums, hemispheres, or any other shape of protrusion. The shape of the host device pins 330-334 may correspond to the shape of mating cups 140-144 of connector 160 as depicted in FIG. 1. This may help the connector to self-locate and, when the connector and socket are mated, provide consistent contact between the mated pins. For example, the host device pins 330-334 may enter a portion of the mating cups of the connector when the connector and socket mate. In addition, although the shape of the host device pins 330-334 and mating cups 140-144 are circular, the mating cups and pins may be other shapes as well. For example, the pins and mating cups may be oval or trapezoidal.

Figure 4:
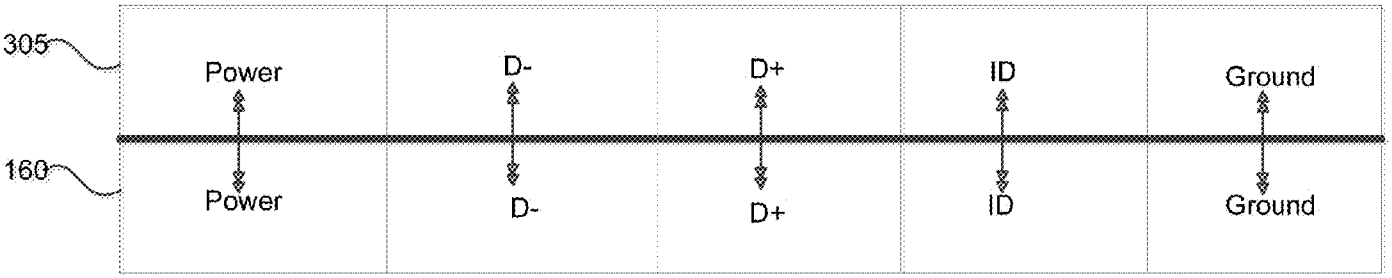
FIG. 4 is an example of signal transmittal between the socket and the connector in accordance with aspects of the disclosure.

Each of the connector and host device pins may have a designated functionality, such as Power, Ground, D+, D−, and ID. In addition, the type of pins on the connector may correspond to the type of pins on the host device. For instance, example 400 of FIG. 4 depicts the power pin of host device 305 aligned with the power pin of connector 160 to facilitate the successful transfer of current. As shown in FIG. 4, similar alignments and configurations occur with the remainder of the pins, namely the D+ and D− pins, the ID pin and the Ground pin. The transfer of current, signals, data, etc. is illustrated by the two way double arrows.

Referring back to FIG. 1, power pin 130 may be dedicated to transferring current between the host device and connector. For example, if the transceiving device is a power plug, then electrical current may travel from the electrical outlet, through the plug, cord, connector, and ultimately through the power pin 130 to host device 305.

Data signals (e.g., electrical and audio signals) may travel through Data (D+) pin 131 and Data (D−) pin 132 of the connector to or from the host device. Data may be in the form of electrical or audio signals, which translates to sounds, information content and other forms of data.

The Ground pin 134 may be configured to maintain the conducting circuit, and perform the functions typically associated with Ground in an electrical circuit.

The ID pin 133 may allow for the identification of the transceiving device. For example, the transceiving device may be attached or connected to a second end of the cord, the connector 160 of which is already attached to a first end of the cord. The ID resistor value may be maintained within the connector housing, and identified/detected by the host device upon connection. For example, the ID resistor value may be maintained in the resistor component, and the resistor value in the resistor component may be different based on the type of tranceiving device that is associated with the connector. The ID resistor value may be used to uniquely identify the class of device that is connected. Classes may include types of USB devices, headphones, microphones, etc. When the connector is mated with the host device, the host device may identify the ID resistor value associated with the connector through the ID pins of the host device and connector. The host device may then determine the type of transceiving device that is connected based on the ID resistor value that is identified.

Example 500 of FIG. 5 provides examples of transceiving devices, their corresponding ID resistor values, and the functions associated with the given ID resistor value. For instance, possible transceiving devices that may be identified include headphones, a microphone, a USB OTG-compliant device, etc. In one example and as shown in FIG. 5, a pair of headphones may correspond to an ID resistor value of one (1), which may then be read by the host device. Although FIG. 5 depicts the ID resistor values as numbers, the ID resistor values may be any type of value capable of identifying the transceiving device, such as alpha or alpha-numeric characters. In addition, example 500 of FIG. 5 is not an exhaustive list of ID resistor values or transceiving devices, but is only illustrative.

Figure 6:
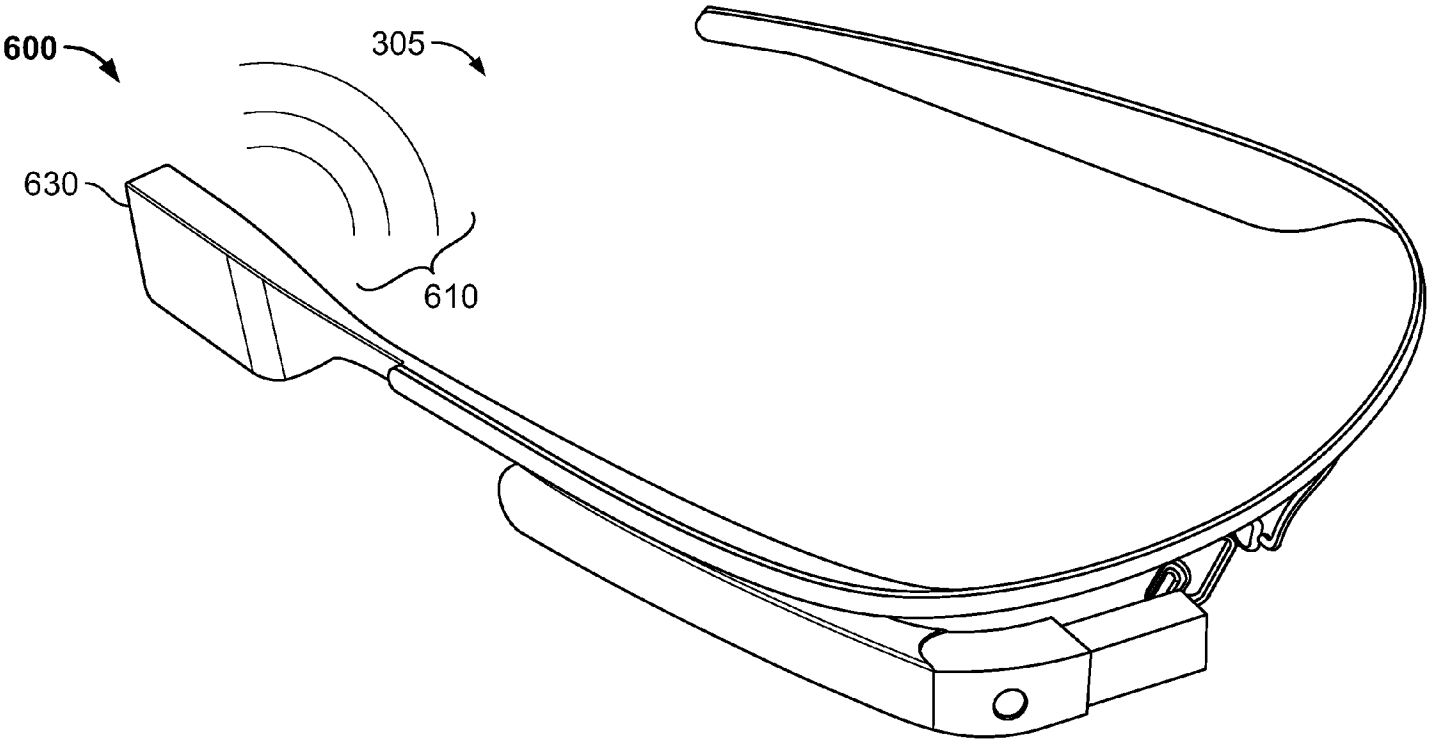
FIG. 6 illustrates an example of audio output in accordance with aspects of the disclosure.
Figure 7:
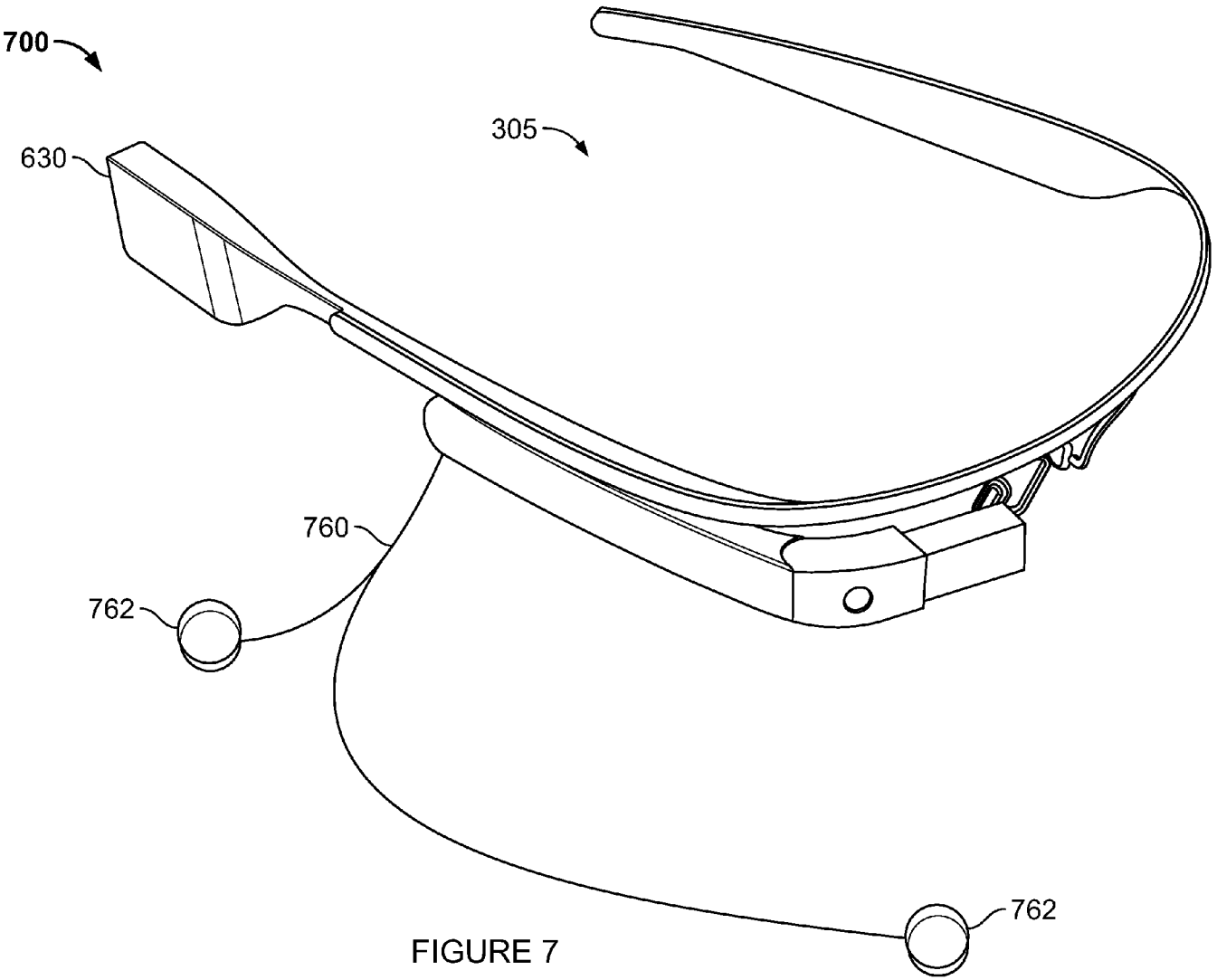
FIG. 7 illustrates an example of headphones changing the audio output of the host device in accordance with aspects of the disclosure.

When the host device identifies the ID resistor value and determines the identity of the transceiving device, aspects of the host device may be altered. For instance, in example 600 of FIG. 6, sound 610 (e.g., music) was emitting from speaker 630 of host device 305. In this example, the host device 305 is a head-mountable display. In example 700 of FIG. 7, however, the sound 610 of FIG. 6 is no longer emitting from speaker 630. In response to identifying the ID resistor value, the one or more processors (described in more detail below) of the host device 305 may disable the speakers associated with the host device and re-route the audio signals through the connector (not shown), cord 760 and to the headphones 762. For example, the audio signals may be sent through the D+ and D− pins of the host device and connector pins (not shown), as opposed to speaker 530.

As another example, the host device may be able to identify the transceiving device based on the voltage and the configuration of the D+ and D− lines. For example, some devices, such as a USB-A cable, do not have an ID resistor value. Ordinarily, this configuration is assumed to represent a standard USB connection to a host computer. As per USB charging standards, if the USB cable is connected to a high-speed wall charger this may be represented by the D+ and D− lines being shorted together by the adapter. This can be detected by the host device to adjust charging characteristics. The pins associated with the host device and connector may be multiplexed to perform more than a single function. As illustrated in example 800 of FIG. 8, the D+ and D− pins may be capable of transmitting data in the form of electrical signals and sound in the form of audio signals. The type of signal transferred may depend on the type of transceiving device connected. By way of example only, if a computing device with a display is connected to debug the host device, then characters encoded by electrical signals may be transferred. On the other hand, if headphones are connected, then sound in the form of audio signals may be transferred. In addition, the Power pin may be multiplexed so as to be able to transfer current and also signals from a microphone. As another example, an attached USB OTG-capable device can act as a slave USB device, thus putting the host device into a USB host mode, whereas typically the host device may be a USB client device when attached to a computer. In this scenario, the host device may modify the Power pin to output power to the requesting OTG device and the D+/D− lines can also be used for transmitting debugging information and application processor console access via Universal Asynchronous Receive/Transmit ("UART"). Other functionalities may also be employed by the pins as well.

According to another example, the size of the cord may vary depending on the transceiving device that is connected. For example, if headphones are connected, then the D+ and D− pins of the host device and connector may transmit audio signals to the headphones. The necessary size of the cord for the headphones is small because a small amount of power and signals are being relayed. However, if the transceiving device is a power plug that plugs into an electrical outlet, then a larger cord may be required to adequately transmit the power from the electrical outlet, through the cord and to the host device.

Figure 9:
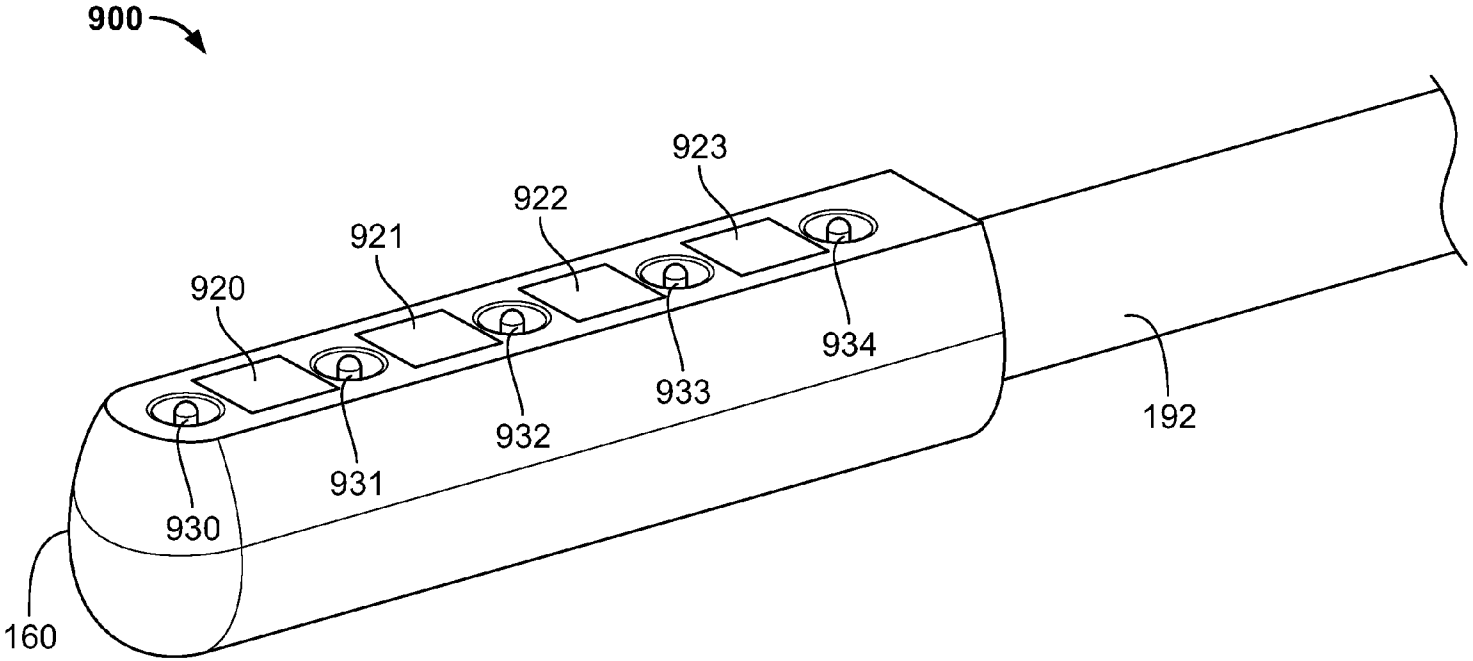
FIG. 9 is an isometric view illustrating another example configuration of pins and magnets in accordance with aspects of the disclosure.

Alternative configurations of the magnets and pins may also be implemented with respect to the connector and host device. For example, FIG. 9 illustrates another example configuration of the pin-magnet formation. In example 900 of FIG. 9 the pins 930-934 and magnets 920-923 alternate. The different configurations of the pins and magnets may produce different magnetic effects, such as to reduce the magnetic pitch inside the device or alter the magnetic retention force.

Figure 10:
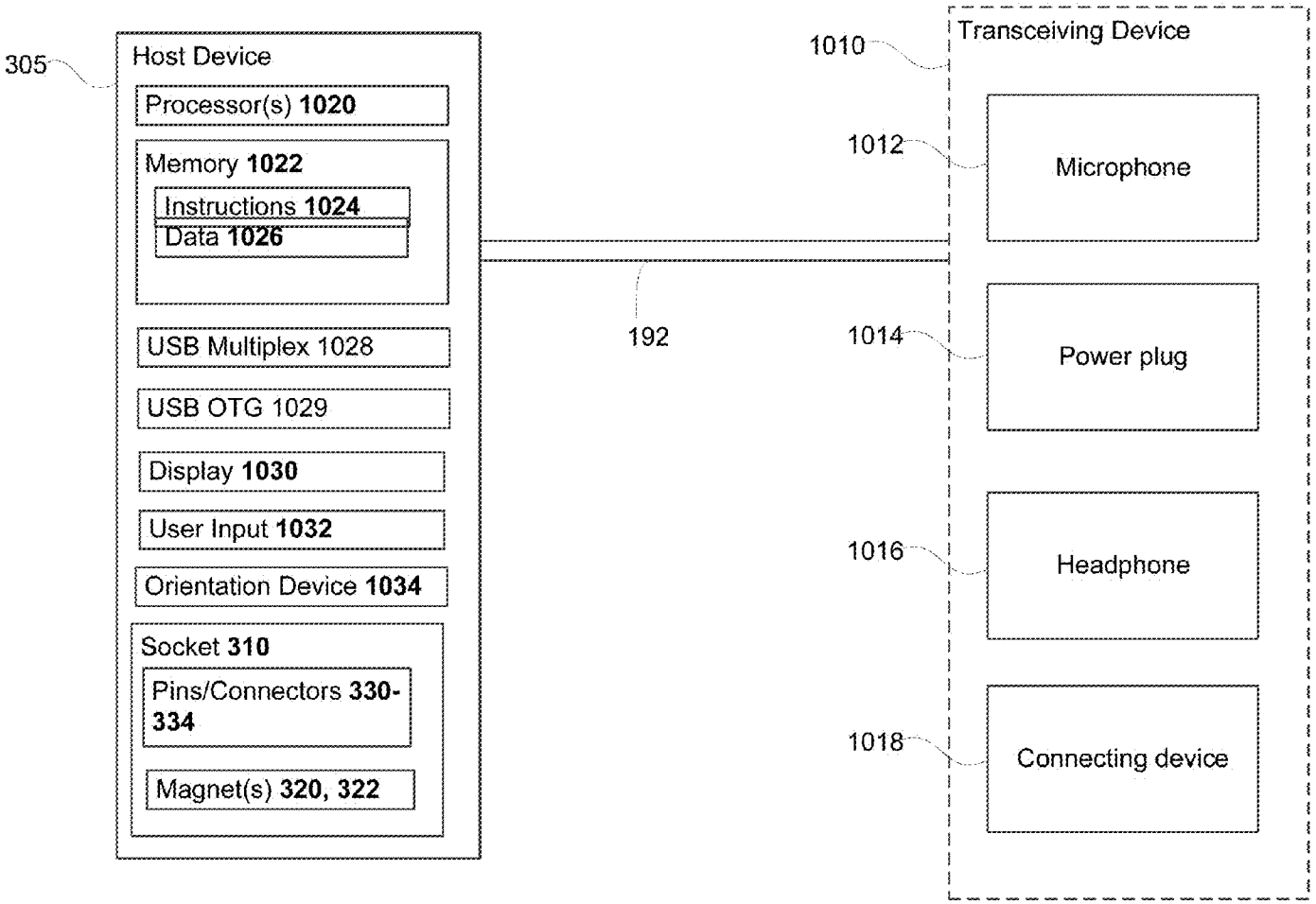
FIG. 10 is a functional diagram of an example system in accordance with aspects of the disclosure.
Figure 11A:
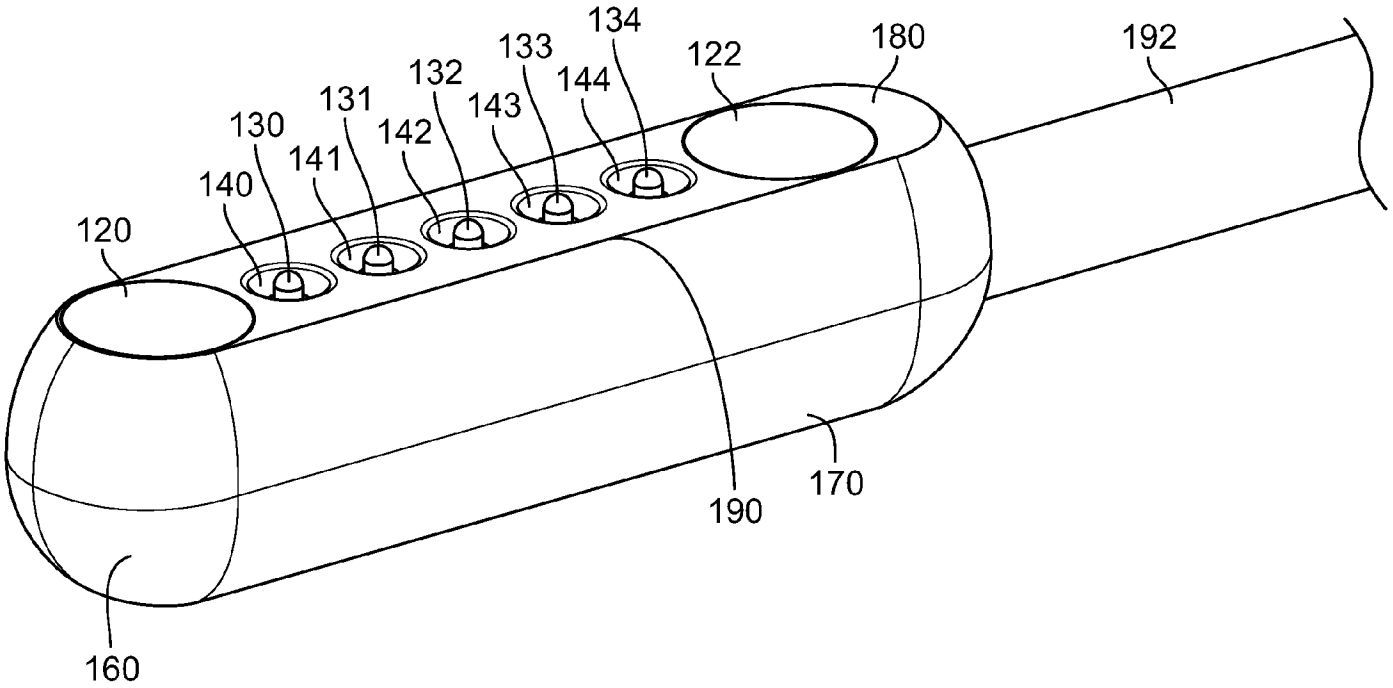
FIGS. 11A-G are examples of a connector in accordance with aspects of the disclosure.
Figure 11C:
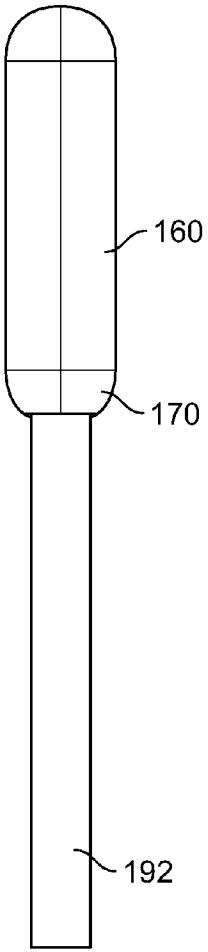
Figure 11B:
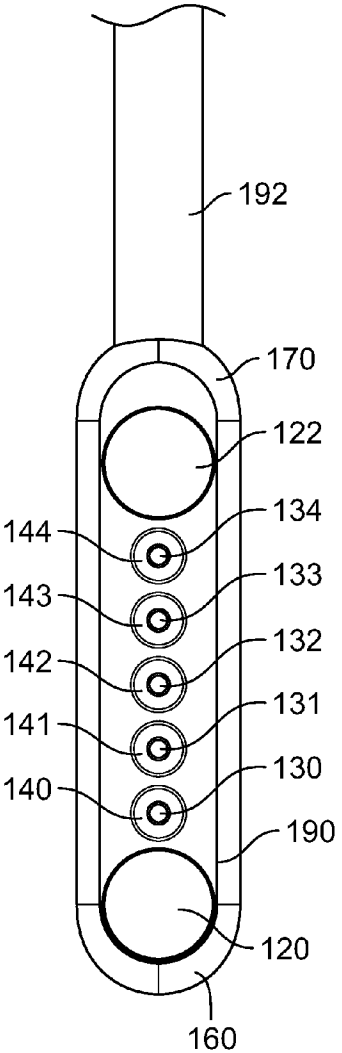
Figure 11D:
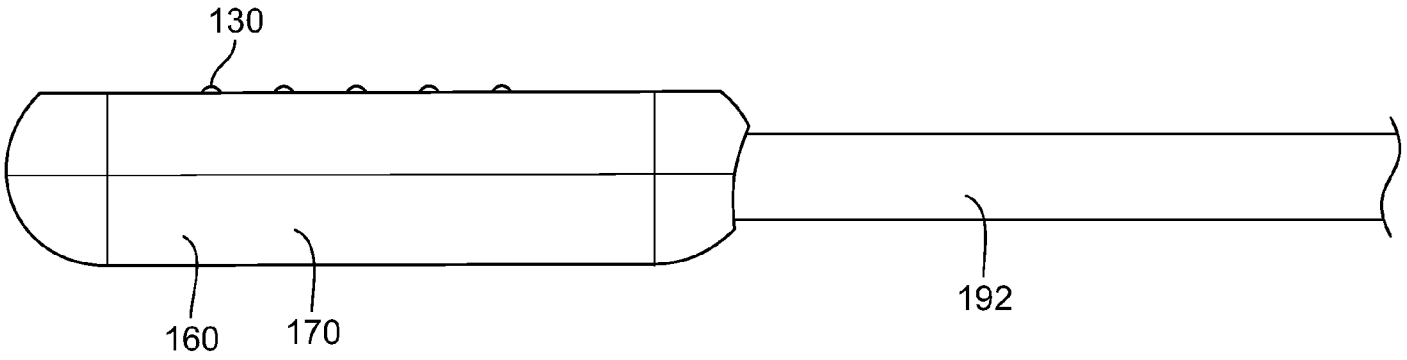
Figure 11E:
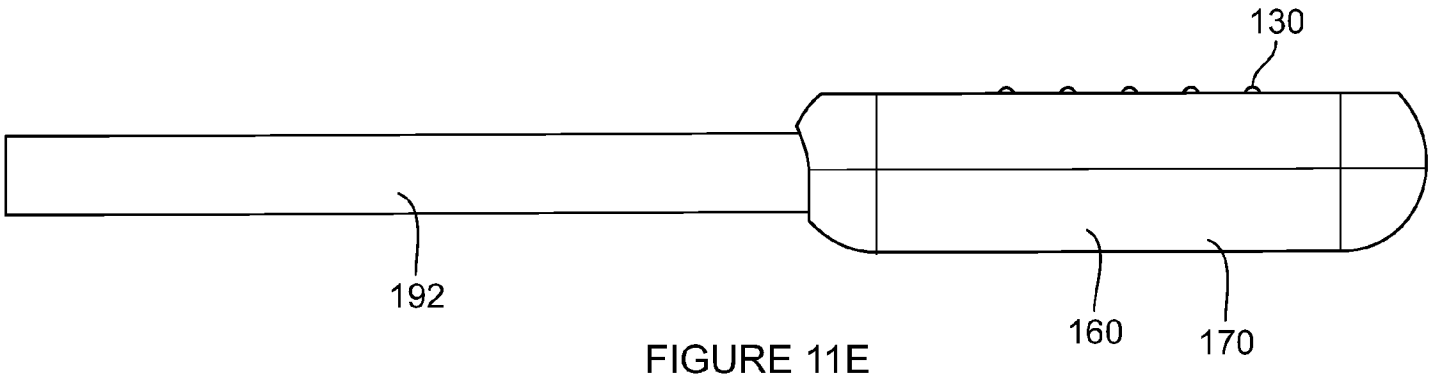
Figure 11G:
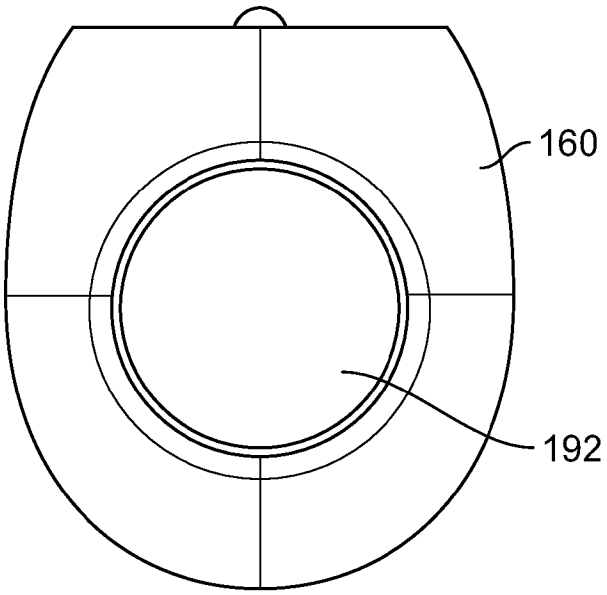
Figure 11F:
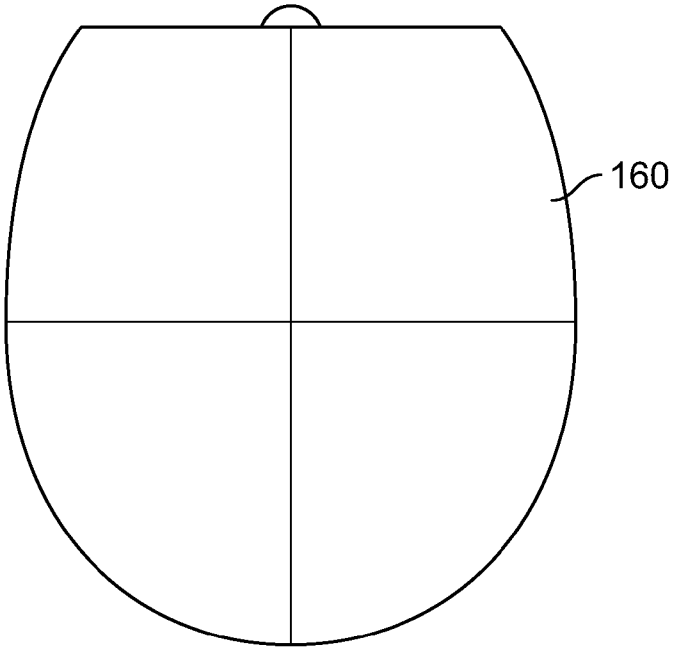
Figure 12A:
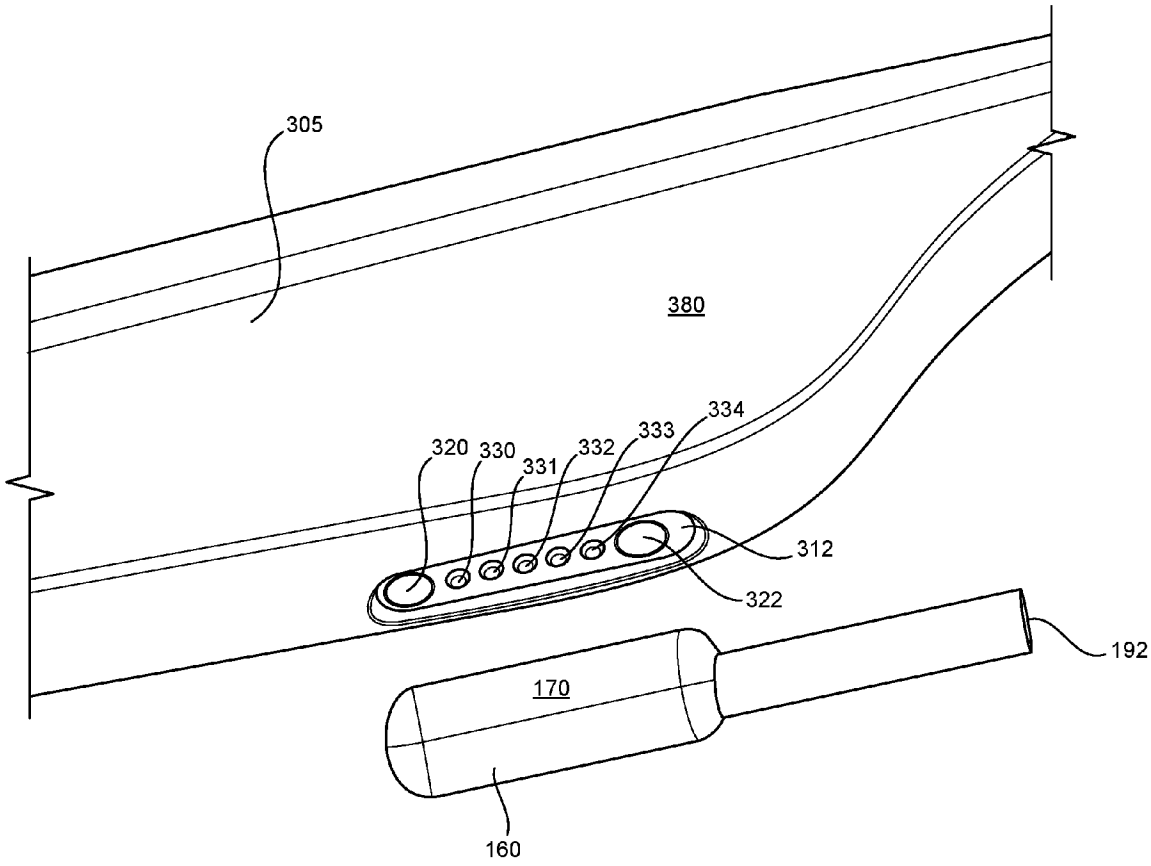
FIGS. 12A-K are examples of a connector and mating socket in accordance with aspects of the disclosure.
Figure 12B:
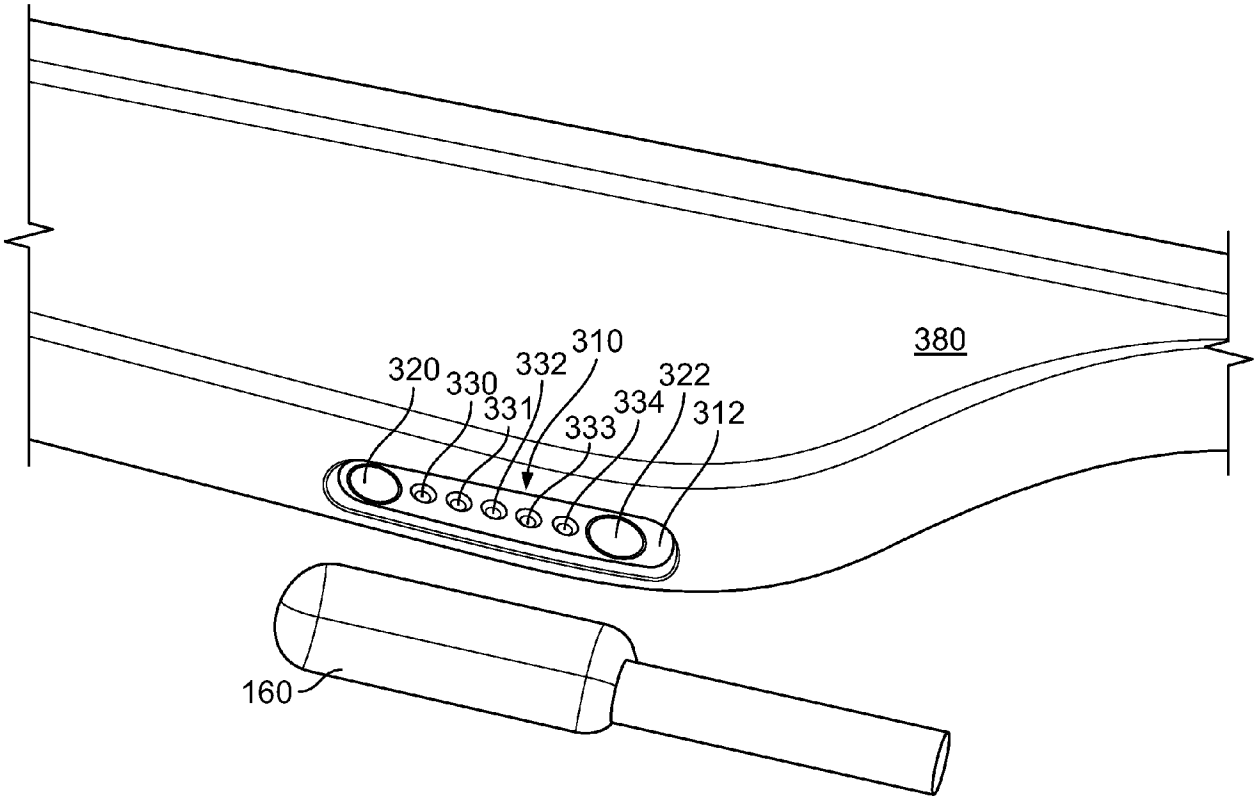
Figure 12C:
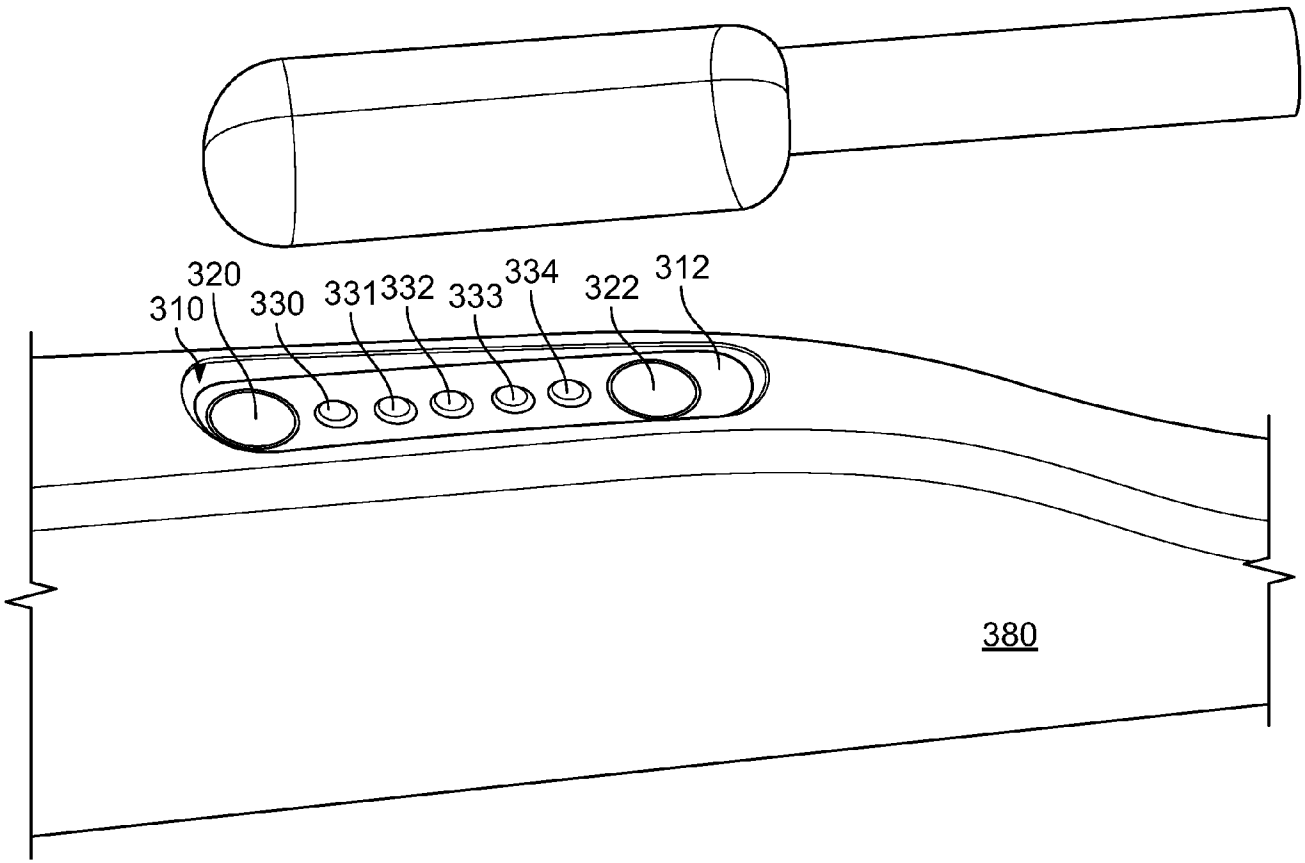
Figure 12D:
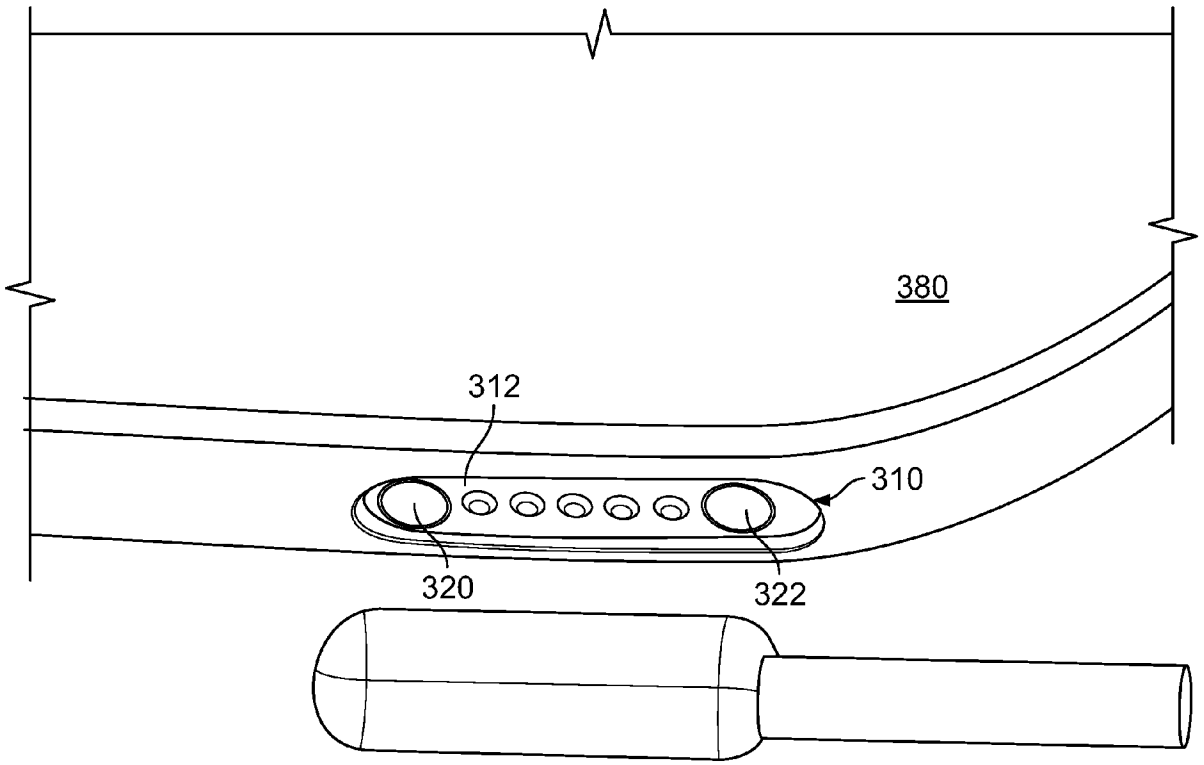
Figure 12E:
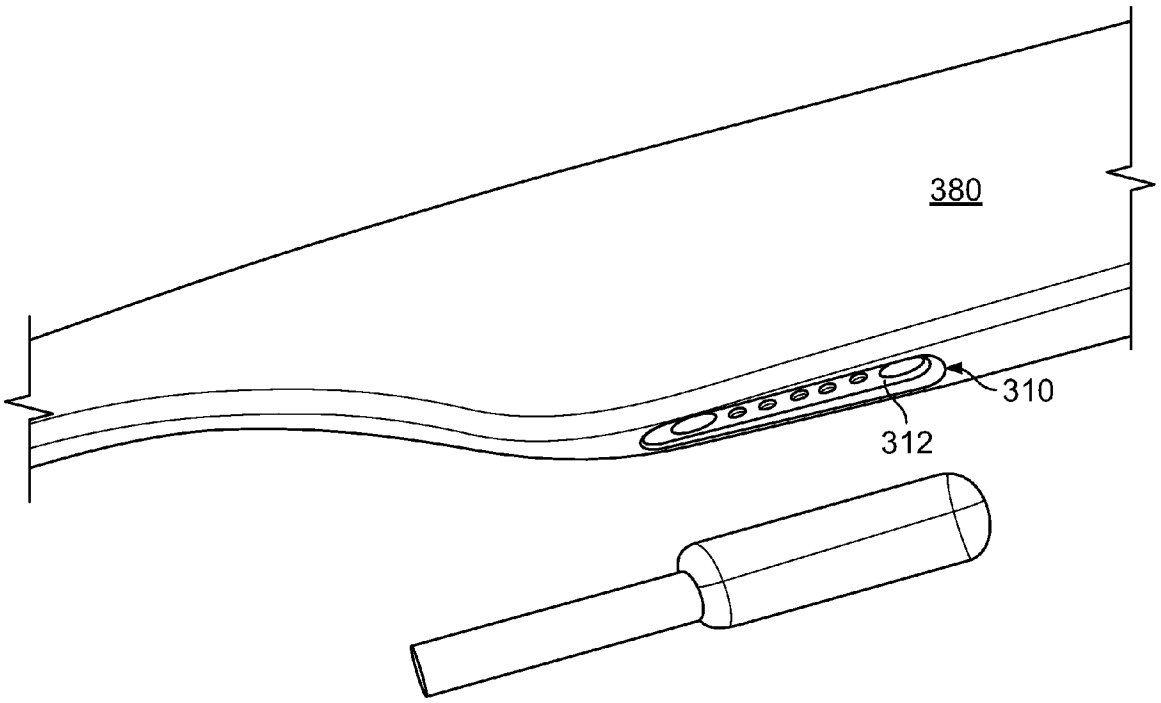
Figure 12F:
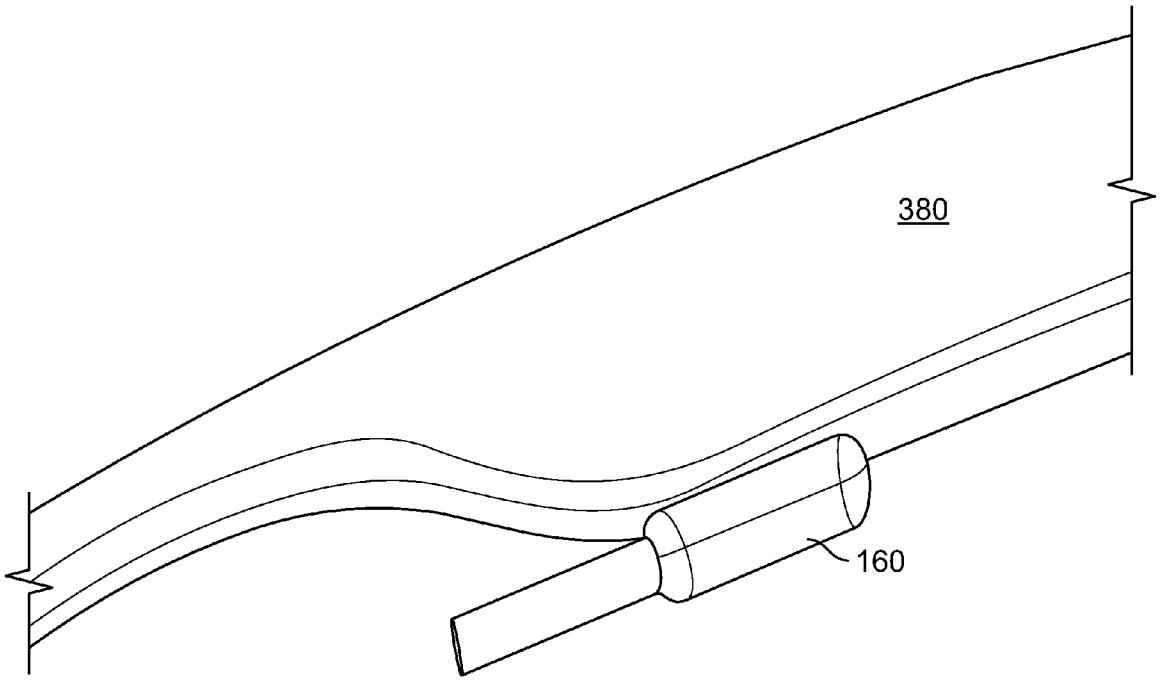
Figure 12G:
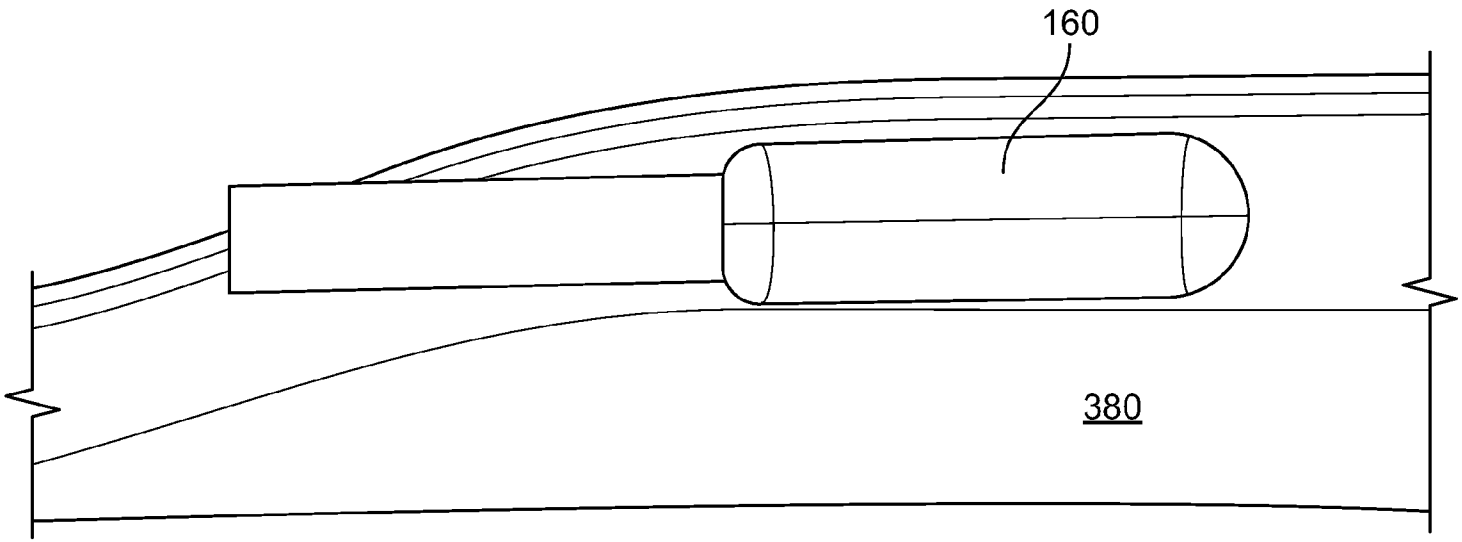
Figure 12H:
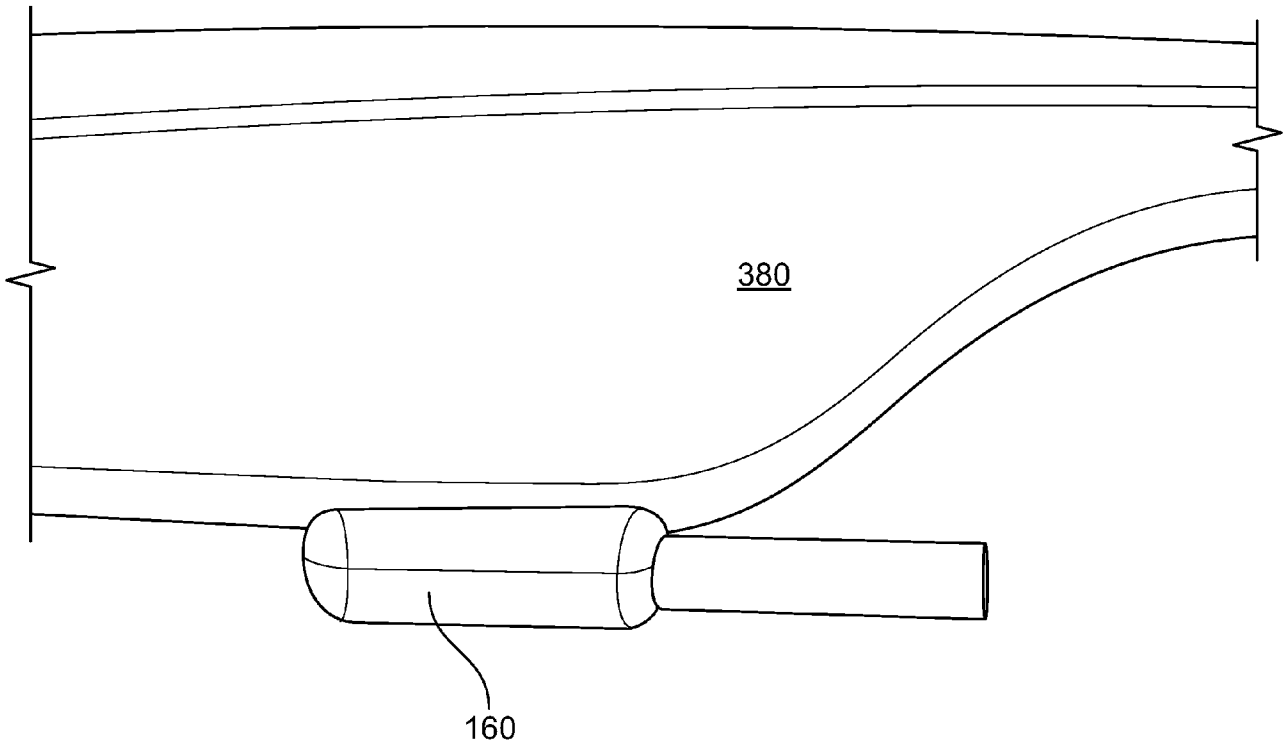
Figure 12I:
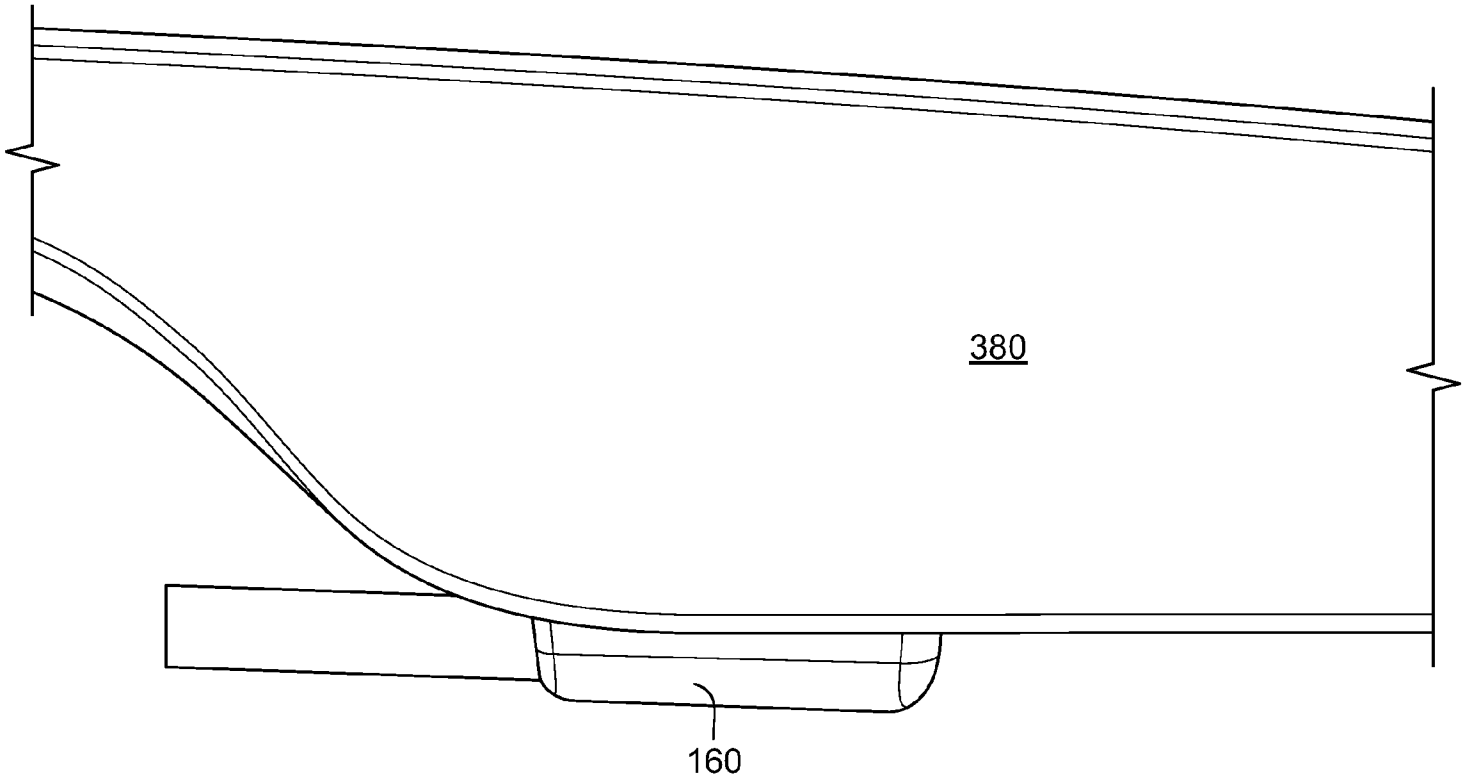
Figure 12J:
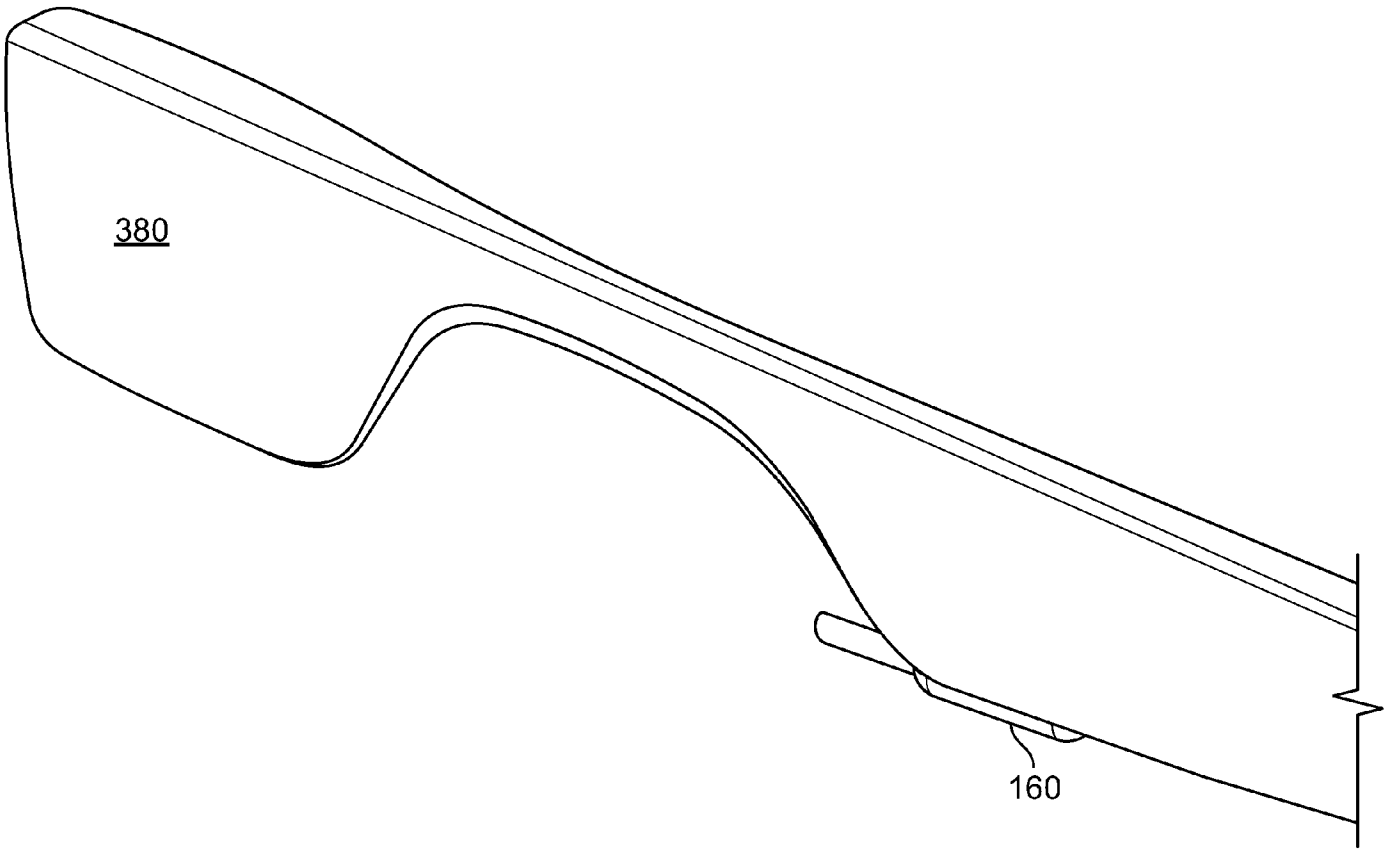
Figure 12K:
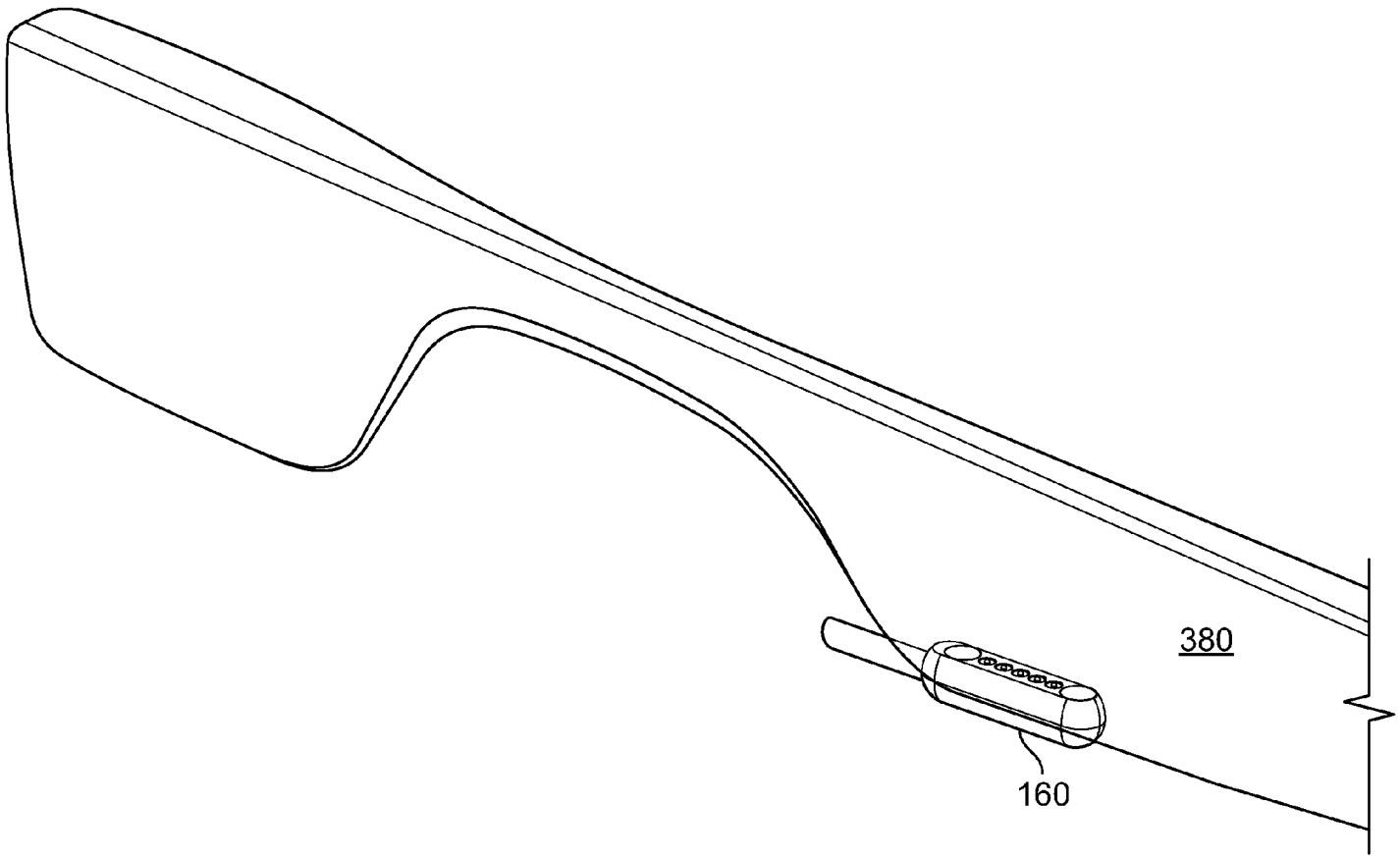

FIG. 10 includes an example system in which the features described above may be implemented. It should not be considered as limiting the scope of the disclosure or usefulness of the features described herein. In this example, system 1000 can include host device 305, a cord 192, and transceiving device 1010. The transceiving device may be any one of a microphone 1012, power plug 1014, headphone 1016, or connecting device 1018 (e.g., a device to connect the host device into a PC, laptop, etc.). The host device 305 and transceiving device 1010 may be connected via cord 192.

Host device 305 may be a personal computing device intended for use by a user. Other examples of host devices 305 may include a head-mountable display, mobile phone or a device such as a wireless-enabled PDA, a tablet PC, smart watch device, or a netbook that is capable of obtaining information via the Internet. The host device may have all of the components normally used in connection with a personal computing device, such as a central processing unit (CPU), memory (e.g., RAM and non-volatile memory) storing data and instructions, a display (e.g., a monitor having a screen, a touch-screen, a projector, a television, or other device that is operable to display information), and user input device 1035 (e.g., a mouse, keyboard, touch-screen or microphone). The host device may also include a camera (not shown) for recording video streams or capturing individual images, speakers, a network interface device, and all of the components used for connecting these elements to one another, such as via Bluetooth. The host device may additionally include an orientation device, such as an Inertial Measurement Unit ("IMU") (e.g., accelerometer, gyroscope, magnetometer), to determine changes in orientation as the host device moves.

The memory 1022 can also include data that can be retrieved, manipulated or stored by the processor 1020. The memory 1022 can be of any non-transitory type capable of storing information accessible by the processor 106, such as a non-volatile memory store, memory card, ROM, RAM, DVD, CD-ROM, write-capable, and read-only memories.

The instructions 1024 can be any set of instructions to be executed directly, such as machine code, or indirectly, such as scripts, by the one or more processors. In that regard, the terms "instructions," "application," "steps" and "programs" can be used interchangeably herein. The instructions can be stored in object code format for direct processing by the processor, or in any other computing device language including scripts or collections of independent source code modules that are interpreted on demand or compiled in advance. Functions, methods and routines of the instructions are explained in more detail below.

Data 1026 can be retrieved, stored or modified by the one or more processors in accordance with the instructions. For instance, although the subject matter described herein is not limited by any particular data structure, the data can be stored in computer registers, in a relational database as a table having many different fields and records, or XML documents. The data can also be formatted in any computing device-readable format such as, but not limited to, binary values, ASCII or Unicode. Moreover, the data can comprise any information sufficient to identify the relevant information, such as numbers, descriptive text, proprietary codes, pointers, references to data stored in other memories such as at other network locations, or information that is used by a function to calculate the relevant data.

The one or more processors 1020 can be any conventional processor, such as a commercially available CPU. Alternatively, the processor can be a dedicated component such as an ASIC or other hardware-based processor. Although not necessary, one or more of host devices 305 may include specialized hardware components to perform specific computing processes, such as decoding video, matching image frames with images, distorting videos, encoding distorted videos, etc. faster or more efficiently.

The host device may also include a geographic position component in communication with the one or more processors for determining the geographic location of the device. For example, the position component may include a GPS receiver to determine the device's latitude, longitude and/or altitude position. The location of the device may include an absolute geographical location, such as latitude, longitude, and altitude as well as relative location information, such as relative to a particular device or object.

The host device may also include other devices in communication with one or more processors, such as an accelerometer, gyroscope or another orientation detection device to determine the orientation of the client device or changes thereto. By way of example only, an acceleration device may determine its pitch, yaw or roll (or changes thereto) relative to the direction of gravity or a plane perpendicular thereto. The device may also track increases or decreases in speed and the direction of such changes. The device's provision of location and orientation data as set forth herein may be provided automatically to the user.

The host device 305 also includes a USB multiplex component 1028 which allows for some of the pins to perform more than one function. For example, as discussed above, the power pin may transfer current along with audio signals. Other pins, as discussed above, may also be multiplexed to perform more than single function. In addition, the host device 305 may have a USB On-The-Go ("OTG") component 1029, thereby allowing the host device 305 to act as a host device when other USB devices are connected to it, such as USB flash drive, digital camera, mouse, or a keyboard.

FIGS. 11A-11G depict various views of an example the connector as described herein. For instance, the connector housing and pins are illustrated.

FIGS. 12A-12G depict various views of the connector and a host device as described above. For example, various views of the connector and the socket of the host device are provided, including views of the connector oriented with the socket prior to mating.

The subject matter described herein is advantageous in that it provides for blind and effortless mating of a connector to a host device. In this regard, while examples above merely describe the connector in connection with a head-mountable display, it should be understood that the connector may be adapted for use with one of a variety of devices. For example, users can more quickly and easily charge their portable devices or use adaptable features, such as headphones. Moreover, the magnets of the connector provide increased safety in the event a wire attached to the connector is accidentally snagged, while still producing a secure coupling when the connector is intended to be in place.

As these and other variations and combinations of the features discussed above can be utilized without departing from the subject matter as defined by the claims, the foregoing description of embodiments should be taken by way of illustration rather than by way of limitation of the subject matter as defined by the claims. It will also be understood that the provision of the examples described herein (as well as clauses phrased as "such as," "e.g.", "including" and the like) should not be interpreted as limiting the claimed subject matter to the specific examples; rather, the examples are intended to illustrate only some of many possible aspects.

The invention claimed is:

1. A connector adapted to mate with a socket in a host device, the connector comprising:

a connector housing, the connector housing having a connector surface and a bottom surface, a first side and second side extending in between the connector and bottom surfaces, and a first end between the connector and bottom surfaces and also between the first and second sides;

a plurality of connector pins extending from the connector surface of the connector housing;

at least one connector magnet coupled to the connector surface of the connector housing, the at least one connector magnet attracts a corresponding first host magnet in the socket of the host device and mates the connector with the host device when the connector is positioned in a given orientation, and the at least one connector magnet repels a second host magnet disposed within the host device and prevents mating of the connector with the host device when the connector is positioned in a different orientation; and a cord attached to the first end of the connector housing, wherein, when the connector is in the given orientation and mates with the socket, at least part of the cord is configured to be flush against and parallel to a housing of the host device.

2. The connector of claim 1, further comprising:

a transceiving device coupled to an end of the cord opposing the connector; and wherein a functionality provided by at least one of the connector pins is based on a type of the transceiving device.

3. The connector of claim 2, wherein:

the connector is configured to store an ID resistor value, the ID resistor value being identified by the host device through a first connector pin of the plurality of connector pins; and the host device is configured to determine a type of transceiving device connected to the second connector based on the received ID resistor value.

4. The connector of claim 1, wherein the connector surface comprises a plurality of mating cups, each mating cup surrounding at least a portion of one of the plurality of pins.

5. The connector of claim 4, wherein each connector pin has a first portion and a second portion, the first portion being enclosed within the connector housing and the second portion being outside the connector housing and surrounded by the mating cup.

6. The connector of claim 5, further comprising:

a spring coiled around the first portion of each connector pin; and a ledge component contained inside the connector housing, the ledge component having a first side facing an inside portion of the connector housing, and a second side facing the spring;

wherein the spring is adapted to exert pressure against the second side of the ledge component, causing the first side of the ledge component to create a seal against the inside portion of the connector housing.

7. The connector of claim 1, wherein:

the at least one connector magnet includes a first connector magnet and a second connector magnet;

the first connector magnet is positioned on a first portion of the connection surface;

the second connector magnet is positioned on a second portion of the connector surface; and at least one of the plurality of pins is positioned between the first portion and the second portion.

8. The connector of claim 1, further comprising a plurality of magnets, the plurality of magnets arranged in an alternating pattern with the connector pins.

9. The connector of claim 1, wherein the cord is attached to the first end of the connector housing such that the cord is obstructed by the host housing when the connector is incorrectly oriented with the socket.

10. A host device including a host housing and a socket adapted to mate with a connector, the socket comprising:

a recess in the host housing, the recess including a base surface and a wall defining an outside perimeter of the recess in the host housing;

a plurality of host pins positioned in the recess, the host pins shaped to fit within a corresponding portion of the connector; and at least one host magnet positioned in the recess, wherein when the connector is positioned in a given orientation and mates with the socket, the at least one host magnet attracts a corresponding first connector magnet and mates the host device and the connector together such that at least part of the cord is flush against and parallel to the host housing, and when the connector is positioned in a different orientation, the at least one host magnet repels a second connector magnet disposed within the connector and prevents mating of the connector and host device.

11. The host device of claim 10, wherein:

the host device is configured to identify an ID resistor value from a first host pin of the plurality of host pins, the first host pin is configured to receive an ID resistor value from the connector, and wherein the host device is adapted to configure the functions of at least one of the host device and the host pins based on the identified ID resistor value.

12. The host device of claim 10, wherein:

the at least one host magnet includes a first host magnet and a second host magnet;

the first host magnet is positioned on a first portion of the socket;

the second host magnet is positioned on a second portion of the socket; and at least one of the plurality of host pins is positioned between the first portion and the second portion.

13. The host device of claim 10, further comprising a plurality of magnets, the plurality of magnets arranged in an alternating pattern with the host pins.

14. A connector system comprising:

a connector, the connector comprising:

a connector housing, the connector housing having a connector surface and a bottom surface, at least a first side and second side extending in between the connector and bottom surfaces, and a first end between the connector and bottom surfaces;

at least one connector pin extending from the connector surface of the connector housing;

a first connector magnet coupled to a first portion of the connector surface; and a second connector magnet coupled to a second portion of the connector surface;

a socket adapted to mate with the connector, the socket comprising:

a recess, the recess including a base surface and a wall defining an outside perimeter of the recess;

at least one host pin positioned in the recess, the at least one host pin positioned and shaped to contact the at least one connector pin;

a first socket magnet attracting the first connector magnet and mating the connector and socket together when the connector is positioned correctly within the socket;

a second socket magnet repelling the first connector magnet and preventing mating of the connector and socket when the connector is positioned incorrectly with respect to the socket; and a cord attached to the first end of the connector housing, wherein when the connector is positioned correctly in the socket, the cord is flush against and parallel to a host device housing the socket.

15. The connector system of claim 14, the connector further comprising at least one mating cup formed on the connector surface and surrounding at least a portion of the at least one connector pin.

16. The connector system of claim 14, wherein when the connector is positioned incorrectly, the cord is obstructed by the host device and prevented from mating with the host device.

17. The connector of claim 14, wherein the recess is formed in a host device, the host device comprising:

one or more processors; and memory coupled to the one or more processors;

wherein the one or more processors are configured to:

identify an ID resistor value from the connector;

determine a type of transceiving device based on the ID resistor value; and perform a function based on the determined ID resistor value.

18. The connector system of claim 17, wherein the ID resistor value is transmitted through an ID pin on the connector and the host device.

19. The connector of claim 1, wherein when the at least one connector is in the first given position, the cord is in a first position relative to the host device, and wherein when the connector is positioned in the different orientation, the cord is in a second position relative to the host device that is different than the first position of the cord.

* * * * *